United States Patent [19]

Uranishi et al.

[11] Patent Number: 4,949,695

[45] Date of Patent: Aug. 21, 1990

[54] DEVICE FOR DETECTING MALFUNCTION OF FUEL EVAPORATIVE PURGE SYSTEM

[75] Inventors: Kouji Uranishi; Kouichi Osawa, both of Susono, Japan

[73] Assignee: Toyota Jidosha Kabushiki Kaisha, Japan

[21] Appl. No.: 384,241

[22] Filed: Jul. 21, 1989

[30] Foreign Application Priority Data

Aug. 10, 1988 [JP] Japan ..... 63-104869[U]

[51] Int. Cl.[5] ..... F02M 39/00

[52] U.S. Cl. ..... 123/520; 123/198 D; 123/494

[58] Field of Search ..... 123/518, 519, 520, 521, 123/198 D, 479, 359, 494

[56] References Cited

U.S. PATENT DOCUMENTS

| | | | |
|---|---|---|---|
| 4,794,903 | 1/1989 | Suzuki | 123/479 |
| 4,809,667 | 3/1989 | Uranishi | 123/520 |
| 4,834,050 | 5/1989 | Uranishi | 123/520 |
| 4,862,856 | 9/1989 | Vokoe | 123/520 |
| 4,865,000 | 9/1989 | Yajima | 123/520 |
| 4,867,126 | 9/1989 | Yonekawa | 123/198 D |
| 4,869,223 | 9/1989 | Shimomura | 123/494 |

FOREIGN PATENT DOCUMENTS

| | | | |
|---|---|---|---|
| 55-29021 | 3/1980 | Japan . | |
| 0086555 | 5/1982 | Japan | 123/519 |
| 57-171169 | 10/1982 | Japan . | |
| 62-203039 | 9/1987 | Japan . | |
| 63-29050 | 2/1988 | Japan . | |
| 63-113158 | 5/1988 | Japan . | |

*Primary Examiner*—Carl Stuart Miller

*Attorney, Agent, or Firm*—Kenyon & Kenyon

[57] ABSTRACT

A device for detecting a malfunction of a fuel evaporative purge system comprises a pressure sensor for detecting gas pressure in a purge passage connecting a canister to an intake pipe, and an intake vacuum sensor for detecting a negative pressure in the intake pipe. In the purging condition, the device determines whether the obtained relationship between the detected negative pressure in the purge passage and the detected intake vacuum is within a predetermined area and judges that a malfunction has occurred in the system when the relationship is not within the predetermined area.

13 Claims, 5 Drawing Sheets

DEVICE FOR DETECTING MALFUNCTION OF FUEL EVAPORATIVE PURGE SYSTEM

BACKGROUND OF THE INVENTION

1. Field of the Invention

The present invention relates to a device for detecting malfunctions of a fuel evaporative purge system provided for emission control of an internal combustion engine, more particularly to a device for a system provided with a canister for absorbing and temporarily storing a fuel vapor, such as gasoline vapor, caused by an evaporation of fuel held, for example, in a fuel tank or a carburetor; the system separating the fuel vapor from an absorbent contained in the canister and supplying same to the combustion chambers of the engine, to be burnt therein.

2. Description of the Related Art

In the conventional fuel evaporative purge system, a driver cannot be made aware of a malfunction of the purging mechanism from the canister until a periodical inspection of the engine is carried out. Therefore, if a malfunction occurs whereby the fuel vapor cannot be purged into the intake pipe, the absorbent contained in the canister will become saturated, and thus fuel vapor from, for example, the fuel tank, will not be absorbed by the absorbent but will flow directly into the atmosphere through an air inlet of the canister.

To prevent this flow of fuel vapor into the atmosphere, a device for detecting a malfunction of the purge system is disclosed in which a fuel vapor sensor is provided at an air inlet of the canister for detecting a flow of fuel vapor through the air inlet to the atmosphere, and a malfunction of the purging mechanism of the system is detected by signals output from the sensor (Japanese Unexamined Utility Model Publication No. 57-171169).

In the above device, however, since the malfunction of the purging mechanism is first detected when the absorbent is saturated and cannot absorb any more fuel vapor, a time lag occurs between a time at which the purging mechanism malfunctions and a time at which the malfunction is detected, depending upon the absorption capability of the absorbent, and thus a warning that a malfunction has occurred is delayed.

Further, in this device, if the fuel vapor cannot be purged to the intake pipe during normal driving conditions because of a malfunction of the system, a large quantity of fuel vapor which has not been absorbed in the absorbent may escape into the atmosphere when the fuel tank is filled with fresh fuel.

SUMMARY OF THE INVENTION

An object of the present invention is to provide a device for detecting a malfunction in a fuel evaporative purge system, which device can rapidly and precisely detect a malfunction of the purging mechanism of the system.

Therefore, according to the present invention, there is provided a device for detecting a malfunction of a fuel evaporative purge system provided with a canister for absorbing fuel vapor evaporated from stored fuel, a purge passage connecting said canister to an intake pipe of an engine, a valve arranged in said purge passage, and means for opening said valve when said engine is operating under a predetermined driving condition, to thereby supply fuel vapor held in said canister to the intake pipe, said device comprising:

means for detecting a flow of fuel vapor in said purge passage at the predetermined driving condition;

means for comparing the detected flow of fuel vapor with a predetermined flow of said fuel vapor when said system is operating normally; and means for determining whether a malfunction has occurred in said system, said determining means cooperating with said comparing means to detect a malfunction of said system.

The present invention will be more fully understood from the description of the preferred embodiments thereof set forth below, together with the accompanying drawings.

DESCRIPTION OF THE PREFERRED EMBODIMENTS

Figure 1:
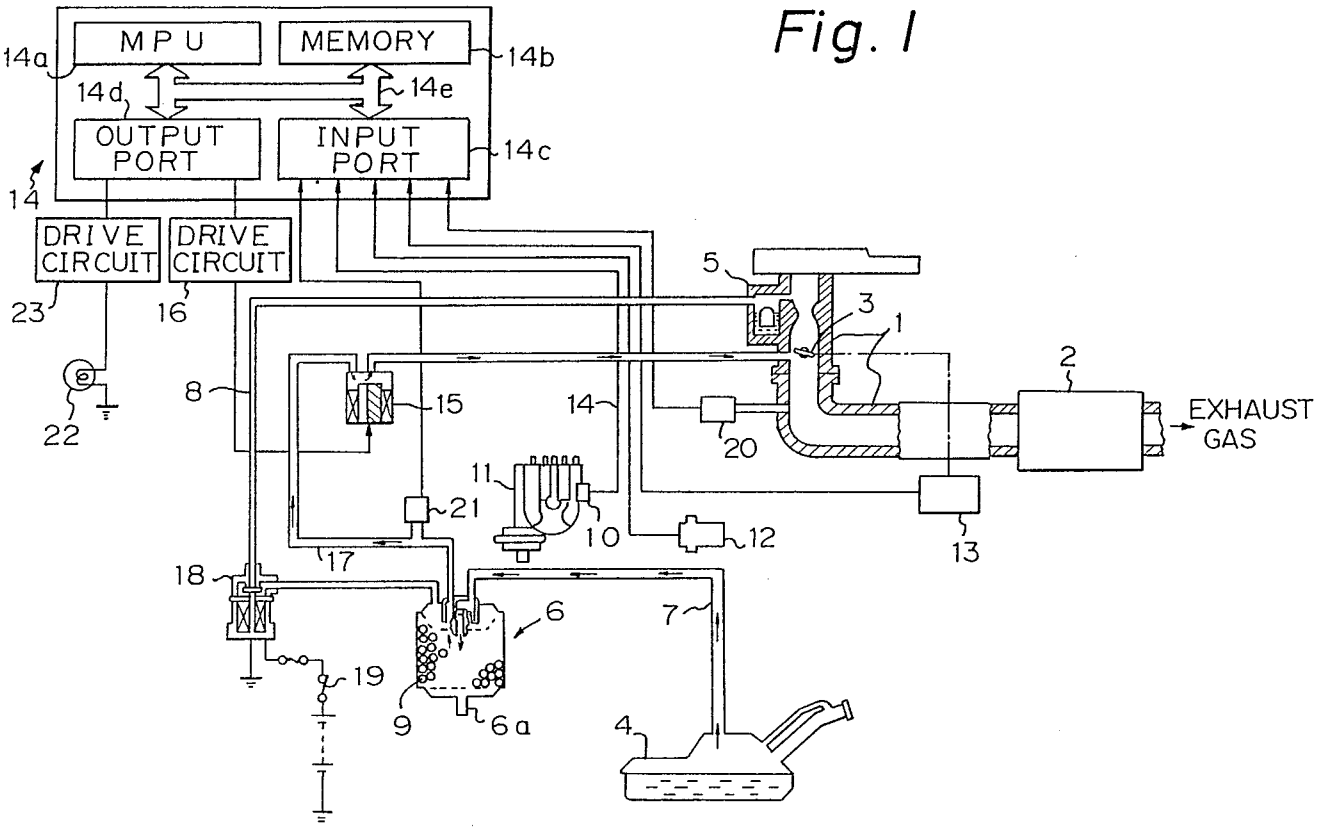
FIG. 1 is a schematic view of a device for detecting a malfunction of a fuel evaporative purge apparatus according to a first embodiment of the invention.

FIG. 1 shows a fuel evaporative purge system under a purge condition in which fuel vapor is purged into an intake system of an engine during normal driving conditions. In FIG. 1, reference numeral 1 designates an intake pipe through which intake air is introduced into an engine 2 provided with combustion chambers (not shown), and 3 is a throttle valve provided in the intake pipe 1.

Fuel vapor evaporated from a fuel tank 4 and fuel vapor evaporated from a carburetor 5 are fed to a canister 6 through vapor passages 7 and 8, respectively. The canister 6 contains an absorbent 9, such as activated carbon, and the fuel vapor is absorbed by this absorbent 9.

The actual driving conditions of the engine 2 are detected by an engine speed sensor 10 mounted on a distributor 11, a coolant temperature sensor 12, and a throttle position sensor 13 associated with the throttle valve 3, through the signals output by these sensors 10, 12, and 13 to a control circuit 14. The control circuit 14 is constructed by a microcomputer which comprises a microprocessing unit (MPU) **14*a*, a memory 14*b*, an input port 14*c*, an output port 14*d*, and a bus 14*e*** interconnecting these components.

The input port **14*c* receives various signals from the sensors 10, 12, and 13**, which indicate the current engine driving condition.

When the engine driving condition detected by the sensors 10, 12, and 13 is a predetermined driving condition, for example, when the vehicle is driven at a high speed, the output port **14*d* of the control circuit 14** outputs an "ON" signal to a solenoid valve 15 through a drive circuit 16.

The solenoid valve 15 is arranged in a purge passage 17 connecting the canister 6 to the intake pipe 1, and upon receiving the "ON" signal, the solenoid valve 15 is opened to allow communication between the canister 6 and the intake pipe 1.

Accordingly, a negative pressure, i.e., the intake vacuum, is introduced into the canister 6 through the purge passage 17 and fuel vapor absorbed in the absorbent 9 is separated therefrom and purged to the intake pipe 1, together with fresh air introduced through an air inlet 6a of the canister 6.

The absorption capability of the absorbent 9 is recovered by this separation of the fuel vapor therefrom.

Hereinafter, the above predetermined driving condition will be called "the purging condition". Note, according to this embodiment, another solenoid valve 18 is arranged in the vapor passage 8 connecting the carburetor 5 to the canister 6, and this solenoid valve 18 is activated by an ignition switch 19 in such a manner that it cuts communication between the carburetor 5 and the canister 6, through the vapor passage 8, when the engine 2 is running. Reference numeral 20 designates an intake vacuum sensor arranged between the throttle valve 3 and the engine 2 for detecting a negative pressure in the intake pipe 1.

According to the embodiment shown in FIG. 1, a pressure sensor 21 is arranged in the purge passage 17, between the solenoid valve 15 and the canister 6, to detect a pressure of the fuel vapor in the purge passage 17, and signals output from the pressure sensor 21 are transmitted to the input port 14c of the control circuit 14. Note, when purging, this pressure normally has a value smaller than atmospheric pressure, and therefore, this pressure can be called a "negative pressure".

When the control circuit 14 outputs an "ON" signal to open the solenoid valve 15, i.e., when the engine 2 is operating under the predetermined driving condition (purging condition), signals are output by the pressure sensor 21 and the intake vacuum sensor 20 to the input port 14c of the control circuit 14, whereby the pressure in the purge passage 17 and a vacuum in the air intake pipe 1 are detected by the control circuit 14. If the control circuit 14 determines that the relationship between the gas pressure and the intake vacuum does not meet a predetermined condition stored in the memory 14b, as described in detail later, the control circuit 14 outputs an "ON" signal to a warning lamp 22 through a drive circuit 23.

In general, the relationship between the pressure in the purge passage 17 and the intake vacuum in the intake pipe 1 when the solenoid valve 15 is opened is such that, when the intake vacuum becomes higher the pressure in the purge passage 17 is correspondingly raised.

Figure 2:
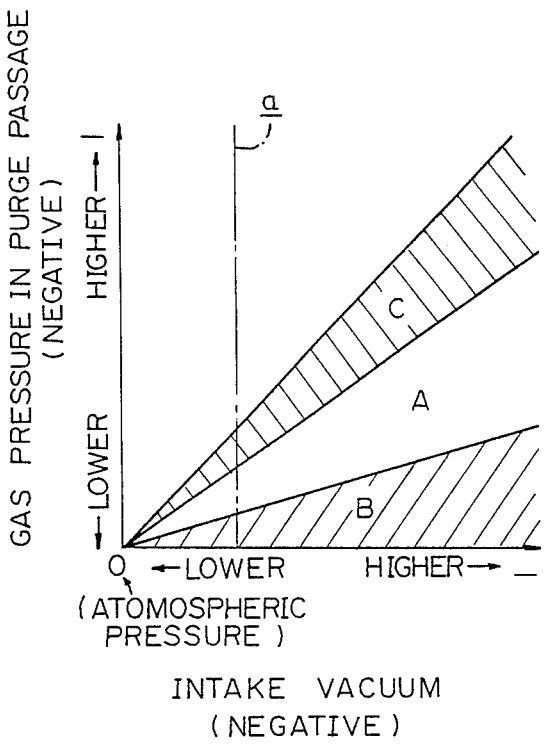
FIG. 2 shows the relationship between the pressure of an intake pipe and the gas pressure in a purge passage during a purge, in the cases of a normal and an abnormal operation of the apparatus.

FIG. 2 illustrates the relationship between the (negative) pressure in the purge passage 17 and the intake vacuum (negative pressure) in the intake pipe 1, in the cases described below.

Referring to FIGS. 1 and 2, when the fuel vapor is purged from the canister 6 to the intake pipe 1 under normal conditions, the value of the negative pressure in the purge passage 17 will be lower than the value of the intake vacuum, i.e., the former is closer to atmospheric pressure than the latter, as the pressure in the vicinity of the air inlet 6a of the canister 6 is substantially atmospheric pressure; i.e., the relationship between the negative pressure in the purge passage 17 and the intake vacuum during a normal operation of the purging system is within an area A shown in FIG. 2.

On the other hand, when the solenoid valve 15 cannot be opened by an "ON" signal from the control circuit 14, due to a malfunction of the system, a pressure detected by the pressure sensor 21 will be closer to a substantially atmospheric pressure than the detected intake vacuum, since the intake vacuum in the intake pipe 1 cannot be detected by the pressure sensor 21 in the purge passage 17. Also, when a part of the purge passage 17 between the pressure sensor 21 and the intake pipe 1 is blocked by foreign matter, the pressure detected by the pressure sensor 21 will be still closer to the substantially atmospheric pressure than the detected intake vacuum, in comparison with the aforementioned relationship. Therefore, the relationships between the pressures in these cases are within an area B shown in FIG. 2.

Further, if the air inlet 6a of the canister 6 is blocked by foreign matter, the difference between the negative pressure detected by the pressure sensor 21 and the intake vacuum detected by the intake vacuum sensor 20 will be less in comparison with the difference therebetween during a normal operation of the system, and thus the relationship between these pressures is within an area C shown in FIG. 2.

Consequently, according to the present invention, by taking the above-mentioned relationships, which are obtained by experiment, into account and comparing the pressure detected by the pressure sensor 21 with a predetermined range of pressures defined in accordance with the intake vacuum detected by the vacuum sensor 20, it can be determined whether or not a malfunction of the purging system has occurred, and further, it can be determined which part of the system is malfunctioning. Note, due to a small difference between the above pressures when the engine 2 is operating in a low intake vacuum condition, i.e., the negative pressure is closer to atmospheric pressure, it is difficult to determine whether or not the system is malfunctioning, and thus preferably this determination is carried out under specific driving conditions in which the intake vacuum is higher than a predetermined value a, as illustrated in FIG. 2.

Figure 3:
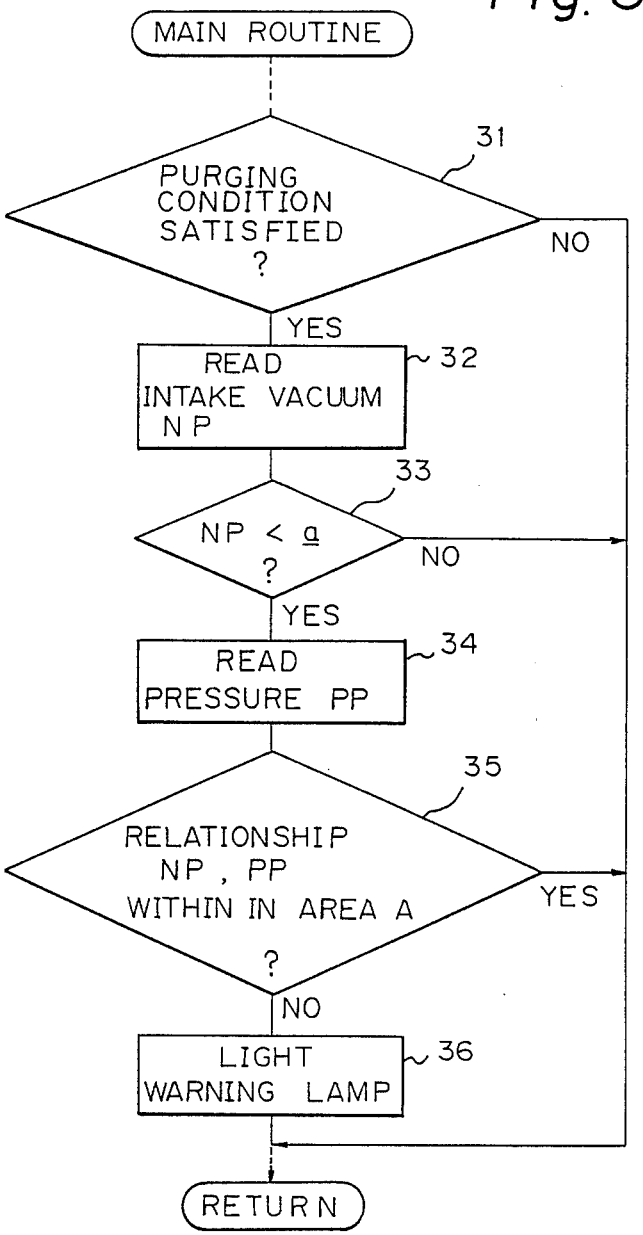
FIG. 3 is a flow chart of the routine carried out by a control circuit shown in FIG. 1, according to the present invention.

FIG. 3 is a flow chart of a part of a main routine for carrying out the control of the engine 2. In this main routine, the process is returned to the first step after reaching the last step thereof, and thus this process is carried out repeatedly while the engine 2 is running.

As shown in the Figure, at step 31 it is determined whether or not the predetermined driving condition corresponding to the purging condition is satisfied. In this embodiment, when the engine 2 is operated under the purging condition, the control circuit 14 outputs an "ON" signal to the solenoid valve 15. Therefore, the determination of the predetermined driving condition at step 31 can be replaced by a determination of whether or not the "ON" signal has been output from the output port 14d of the control circuit 14.

If the purging condition is satisfied, the process goes to step 32, at which the intake vacuum NP is detected by the intake vacuum sensor 18. In this embodiment, as mentioned above, when a value of the detected intake vacuum is lower than the predetermined value a in FIG. 2, i.e., when the detected intake vacuum NP is between the atmospheric pressure and a, the determination of whether or not the system is malfunctioning can not be reliably executed. Therefore, at step 33, it is determined whether or not the intake vacuum NP detected at step 32 is higher (smaller) than the predetermined negative pressure a.

When the intake vacuum is higher (smaller) than the value a, i.e., when the determination condition is satisfied, the process goes to step 34, where the pressure PP in the purge passage 17 is detected by the pressure sensor 21. Then, at step 35, it is determined whether or not a point corresponding to the detected intake vacuum NP and pressure PP, i.e., the relationship between the two negative pressures, is within the area A in FIG. 2. Note, this diagram shown in FIG. 2 is pre-stored in the memory **14*b* of the control circuit 14**.

When the above point is not within the area A in FIG. 2, i.e., the system is malfunctioning, the process goes to step 36 and the control circuit 14 outputs an "ON" signal to light the warning lamp 22 through the drive circuit 23. This lighting of the warning lamp 22 at step 36 can be also used to turn the lamp 22 ON and OFF to display a code corresponding to the kind of malfunction, i.e., the malfunction is within the area B or within the area C.

If the result is NO at either step 31 or step 33, or YES at step 35, the process proceeds to other steps not shown in FIG. 3, and is returned to the first step after reaching the last step.

Figure 4:
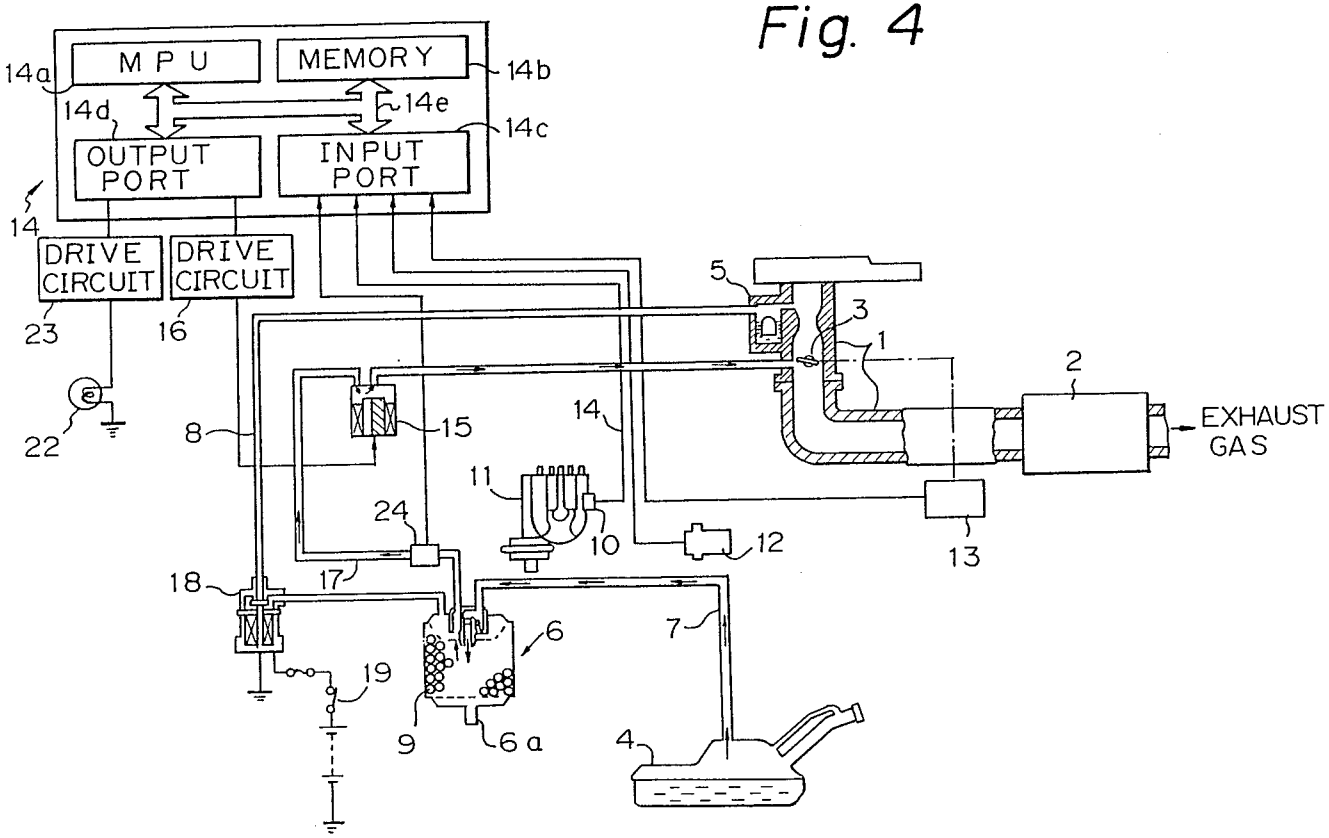
FIG. 4 is a schematic view of a device similar to that shown in FIG. 1, according to a second embodiment of the invention; and, FIG. 5 is a flow chart of a routine carried out by a control circuit shown in FIG. 4, according to the present invention.
Figure 5:
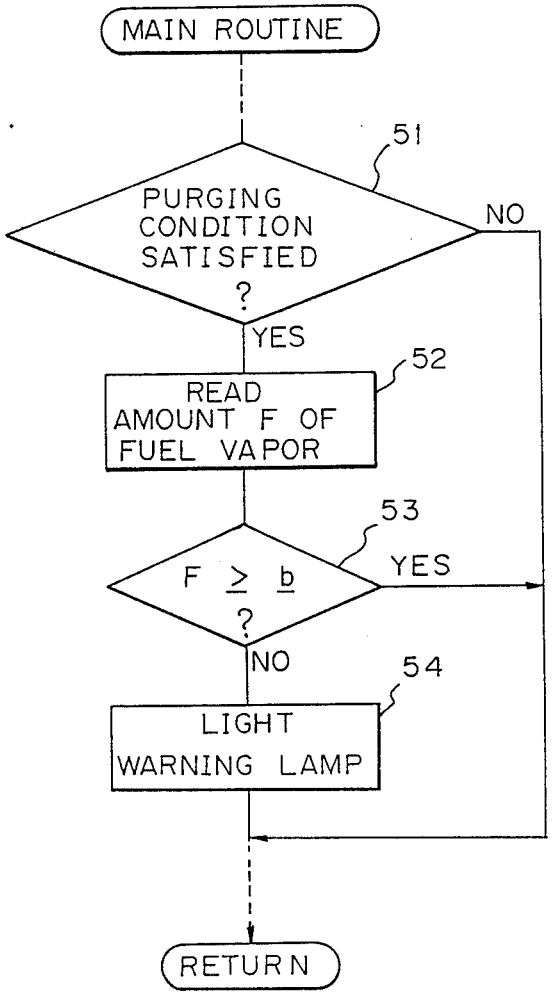

FIGS. 4 and 5 show another embodiment of the present invention. Note, in the embodiment shown in FIG. 4, the same elements as shown for the previous embodiment are indicated by the same reference numerals.

According to this second embodiment, a flow meter 24 is arranged in the purge passage 17 to detect a flow rate of fuel vapor flowing therethrough. This flow meter 24 corresponds to the pressure sensor 21 in the previous embodiment. Note, the intake vacuum sensor 20 is omitted in this embodiment.

The operation of the device according to this embodiment is as follows.

When the engine 2 is under the purging condition, i.e., when the "ON" signal for opening the solenoid valve 15 is output by the control circuit 14, the flow meter 24 outputs a signal to the input port **14*c* of the control circuit 14, whereby the control circuit 14 detects the flow rate F of fuel vapor in the purge passage 17**.

If the detected flow rate F is lower than a predetermined value b, obtained by experiment, it is assumed that, due to a malfunction, the solenoid valve 15 has not been activated, and therefore, there is no communication between the canister 6 and the intake pipe 1, or that the purge passage 17 is blocked by foreign matter. Accordingly, the control circuit 14 transmits the "ON" signal to light the warning lamp 22 through the drive circuit 23.

FIG. 5 is a flow chart of the process for carrying out the operation of the above embodiment. As in the previous embodiment shown in FIGS. 1 to 3, this flow chart is contained in a main routine for carrying out the control of the engine 2.

As shown in the Figure, at step 51 it is determined whether or not the purging condition is satisfied. When the purging condition is satisfied, the process goes to step 52 and the flow rate F of fuel vapor in the purge passage 17 is detected by the control circuit 14 from signals output by the flow meter 24.

Then, at step 53, it is determined whether or not the flow rate F detected at step 52 is higher than the predetermined value b mentioned above. This value b is prestored in the memory **14*b* of the control circuit 14**.

When the flow rate F is not higher than the value b, the process goes to step 54 and the control circuit 14, i.e., the output port **14*d*, outputs the "ON" signal to light the warning lamp 22 through the drive circuit 23**.

If the result is NO at step 51 or YES at step 53, the process goes to other steps not shown in FIG. 5, and returns to the first step after reaching the last step.

As described above, according to the present invention, by providing a means for detecting the flow rate of the fuel vapor, such as a pressure sensor or flow meter, it is possible to quickly and precisely determine whether or not the purge system is malfunctioning, regardless of the absorption capability of the absorbent 9 in the canister 6.

Although embodiments of the present invention have been described herein with reference to the attached drawings, many modifications and changes may be made by those skilled in this art without departing from the scope of the invention.

We claim:

1. A device for detecting a malfunction of a fuel evaporative purge system provided with a canister for absorbing fuel vapor evaporated from stored fuel, a purge passage connecting said canister to an intake pipe of an engine, a valve arranged in said purge passage, and means for opening said valve when said engine is operating under a predetermined driving condition, to thereby supply fuel vapor held in said canister to the intake pipe, said device comprising:

means for detecting a flow of fuel vapor in said purge passage at the predetermined driving condition;

means for comparing the detected flow of fuel vapor with a predetermined flow of said fuel vapor when said system is operating normally; and means for determining whether a malfunction has occurred in said system, said determining means cooperating with said comparing means to detect a malfunction of said system.

2. A device according to claim 1, wherein said flow of fuel vapor is represented by a pressure in said purge passage, said pressure being related to a negative pressure in said intake pipe when said valve is opened.

3. A device according to claim 2, wherein said detecting means comprises a pressure sensor arranged in said purge passage to detect said pressure of fuel vapor in said purge passage.

4. A device according to claim 3, further comprising an intake vacuum sensor arranged between a throttle valve and the engine to detect said negative pressure in said intake pipe, wherein said comparing means compares said pressure detected by said pressure sensor with predetermined pressures defined in accordance with said negative pressure detected by said intake vacuum sensor.

5. A device according to claim 4, wherein said determining means determines whether a malfunction has occurred in said system when said negative pressure detected by said intake vacuum sensor is higher than a predetermined value.

6. A device according to claim 1, wherein said flow of fuel vapor is represented by a flow rate of the fuel vapor in said purge passage.

7. A device according to claim 6, wherein said detecting means comprises a flow meter arranged in said purge passage to detect said flow rate of the fuel vapor.

8. A device according to claim 7, wherein said comparing means compares the detected flow rate of the fuel vapor with a predetermined flow rate.

9. A device according to claims 5 or 8, wherein said determining means includes a warning lamp which is activated when a malfunction has occurred in said system.

10. A device according to claim 9, wherein said stored fuel is stored in a fuel tank and a carburetor.

11. A device according to claim 10, wherein said canister contains an activated carbon.

12. A device according to claim 11, wherein said valve arranged in said purge passage is a solenoid valve.

13. A device according to claim 12, wherein said predetermined driving condition is detected by at least one of an engine speed sensor, a coolant temperature sensor, and a throttle position sensor.

* * * * *